US005458466A

United States Patent [19]

Mills

[11] Patent Number: 5,458,466

[45] Date of Patent: Oct. 17, 1995

[54] MONITORING PUMP STROKE FOR MINIMIZING PUMP-OFF STATE

[76] Inventor: Manuel D. Mills, 2808 Delano Ave., Midland, Tex. 79701

[21] Appl. No.: 139,819

[22] Filed: Oct. 22, 1993

[51] Int. Cl.[6] ..... F04B 49/00

[52] U.S. Cl. ..... 417/12; 417/18; 417/42; 417/44.1; 417/53

[58] Field of Search ..... 417/12, 18, 42, 417/53, 44.1

[56] References Cited

U.S. PATENT DOCUMENTS

| | | | |
|---|---|---|---|
| 3,930,752 | 1/1976 | Douglas | 417/12 |
| 3,936,231 | 2/1976 | Douglas | 417/12 |
| 3,998,568 | 12/1976 | Hynd | 417/12 |
| 4,487,061 | 12/1984 | McTamaney et al. | 73/151 |
| 4,507,055 | 3/1985 | Fair et al. | 417/12 |
| 4,583,915 | 4/1986 | Montgomery et al. | 417/18 |
| 4,873,635 | 10/1989 | Mills | 364/422 |
| 5,064,349 | 11/1991 | Turner et al. | 417/53 |
| 5,224,834 | 7/1993 | Westerman et al. | 417/45 |
| 5,314,016 | 5/1994 | Dunham | 166/250 |

*Primary Examiner*—Henry A. Bennett
*Assistant Examiner*—Xuan M. Thai
*Attorney, Agent, or Firm*—Aquilino & Welsh

[57] ABSTRACT

Fluid pounding in a pumpjack is minimized by dictating the length of the run cycles of the pumpjack. The pumpjack is first allowed to pump down until a fluid pounding state is reached, at which time it is shut down. The time it takes to reach this state is monitored. Using the length of time it took to reach the fluid pounding state, the pumpjack is set to run a predetermined number of dictated cycles for a length of time which is 70–99% of the time it took to reach the fluid pounding state. During these predetermined number of cycles if the pumpjack again reaches a fluid pounding state the time is reset based on this new information, and the number of predetermined number of dictated cycles left is finished. After the predetermined number of cycles has finished, the process is repeated by allowing the pumpjack to run to a fluid pounding state.

18 Claims, 9 Drawing Sheets

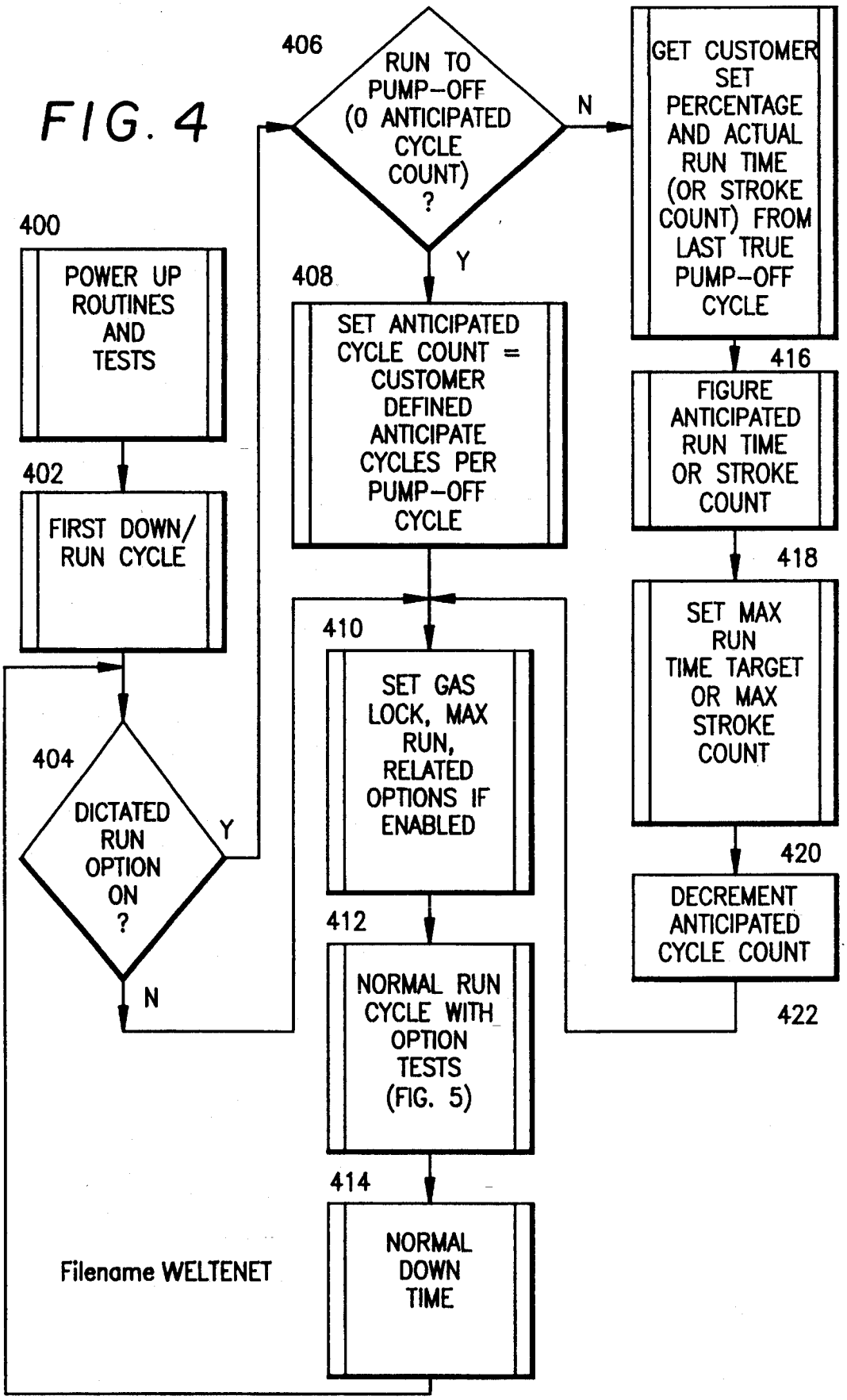
FIG. 4
400
POWER UP ROUTINES AND TESTS
402
FIRST DOWN/ RUN CYCLE
404
DICTATED RUN OPTION ON ?
Y
N
406
RUN TO PUMP-OFF (0 ANTICIPATED CYCLE COUNT) ?
Y
N
408
SET ANTICIPATED CYCLE COUNT = CUSTOMER DEFINED ANTICIPATE CYCLES PER PUMP-OFF CYCLE
410
SET GAS LOCK, MAX RUN, RELATED OPTIONS IF ENABLED
412
NORMAL RUN CYCLE WITH OPTION TESTS (FIG. 5)
414
NORMAL DOWN TIME
GET CUSTOMER SET PERCENTAGE AND ACTUAL RUN TIME (OR STROKE COUNT) FROM LAST TRUE PUMP-OFF CYCLE
416
FIGURE ANTICIPATED RUN TIME OR STROKE COUNT
418
SET MAX RUN TIME TARGET OR MAX STROKE COUNT
420
DECREMENT ANTICIPATED CYCLE COUNT
422
Filename WELTENET

MONITORING PUMP STROKE FOR MINIMIZING PUMP-OFF STATE

BACKGROUND OF THE INVENTION

1. Field of the Invention

The present invention relates to control of pumps. More particularly, the present invention relates to control of pumps by monitoring pump stroke for determining optimum stroke cycles.

2. Description of the Prior Art

Electro-mechanical apparatus for monitoring the operation of sucker rod type well pumping units is known to those skilled in the art as evidenced by my previous U.S. Pat. Nos.: 3,851,995; 4,363,605; 4,043,191; 4,208,665 and 4,873,635.

U.S. Pat. No. 3,817,094 to Montgomery weighs the deflection of the walking beam of a pumpjack unit for providing a signal used for controlling the motor of a pumpjack unit.

U.S. Pat. No. 3,838,597 to Montgomery measures the load during the pumping action and produces a signal which shuts-in the well upon encountering a pump-off condition.

U.S. Pat. No. 4,490,094 to Gibbs measures the instantaneous motor speeds of revolutions for a pumpjack unit, and compares the results with the instantaneous speeds of revolutions of a pump-off condition in order to shut-in a pumpjack unit.

In my U.S. Pat. No. 4,873,635 there is provided a pump-off control (poc) for a pumpjack unit that indirectly measures the efficiency of the pumping action by counting the length of time required for the pumpjack unit to make one complete cycle of operation, or at least a portion of the downstroke. When the measured time interval changes a predetermined amount, the well is shut-in for a predetermined length of time. The portion of the measured pumping cycle must include that part of the downstroke where fluid pounding historically occurs. That disclosure is hereby incorporated by reference.

SUMMARY OF THE INVENTION

It is an object of the present invention to provide pumpjack control which overcomes the problems mentioned above with respect to the prior art.

It is a further object of the invention to provide pumpjack control which minimizes wear and tear on the pumpjack.

It is yet another object of the invention to provide pumpjack controls which optimize pump stroke and down time.

Other objects and advantages of the present invention will become apparent from the following detailed description when viewed with the accompanying drawings.

This invention comprehends a method for controlling a well pump, and more particularly a method by which the operation of a pumpjack unit is monitored and continuously automatically controlled to avoid encountering a pump-off condition. The invention shuts-in a pumpjack unit for a selected length of time before the downhole pump apparatus associated therewith encounters a pump-off condition of operation.

This invention provides a novel method of increasing the pumping efficiency of a pumpjack unit by eliminating up to 99% of the fluid pound strokes while maintaining a pump down fluid level at or just above the downhole pump. The method of this invention utilizes at least some of the software set forth in my previous U.S. Pat. No. 4,873,635 to provide such a pumpoff control.

In my previous U.S. Pat. No. 4,873,635, the time interval for a full stroke to be carried out on a pumpjack unit never exceeds a maximum value of predetermined magnitude unless a pump-off condition or a particular malfunction has occurred. The measured time interval of a stroke is used for generating a signal related to a pump-off condition, and this signal is used in carrying out this invention. This invention enables a computer controlled system to provide shut-in of the well prior to encountering fluid pounding in a manner to avoid up to 99% of destructive fluid pounding phenomena.

My new method of control is achieved by first allowing the pump to reach a fluid pounding state. A determination of the difference in time from the first stroke to the fluid pounding stroke is made, and this time differential is used as a control signal for shutting-in the well. The well is shut-in at a selected time interval that is less than the time differential control signal, and therefore prior to the differential control signal timing out. The well therefore seldom reaches a pumpoff condition of operation. Accordingly, the time differential is a predetermined magnitude that is required for the pumpjack apparatus to avoid undesirable fluid pounding. A new time differential control signal is generated periodically in the same manner to assure the quality thereof.

A computer is programmed to receive information from a transducer and develop a signal that is a measure of the interval between the start of pumping and the fluid pounding state. This measurement of time is used for operating the pumpjack prime mover controller such that the well is shut-in for a predetermined time in response to a selected percent of the measured time differential being reached. The shut-in time is predicated on the stored operating history of the well. After a selected downtime the well is restarted and the pumpjack unit continues to pump in the above recited manner until the probability of encountering fluid pounding is again incurred.

Therefore, a primary object of the present invention is the provision of a method of controlling the operation of a pumpjack unit to reduce the amount of time that the unit operates in a pump-off condition.

Another object of the present invention is the provision of a method of controlling the operation of a pumpjack unit to reduce the amount of time that the unit enters a pump-off condition by using successive time differentials between full barrel pumping and partially full barrel pumping, which is indicative of fluid pounding. The resultant time differential is used by a computer as a signal to shut the well in for a predetermined period of time, and thereafter well production is restarted until another fluid pounding condition is encountered.

An additional object of this invention is the provision of a method for avoiding operation of a pumpjack unit in the fluid pounding mode wherein the cyclic operation of a pumpjack unit is timed each reciprocation of the rod string to provide a time differential between succeeding cycles, which is analyzed to determine the approach of a pump-off condition, and to use this time differential measurement between succeeding cycles to operate a pumpjack unit which less frequently reaches a pumpoff condition.

These and various other objects and advantages of the invention will become readily apparent to those skilled in the art upon reading the following detailed description and claims and by referring to the accompanying drawings.

The above objects are attained in accordance with the present invention by the provision of a method as described herein.

BRIEF DESCRIPTION OF THE DRAWINGS

FIGS. 4 is a flowchart detailing power up of the pumpjack unit.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

Figure 1:
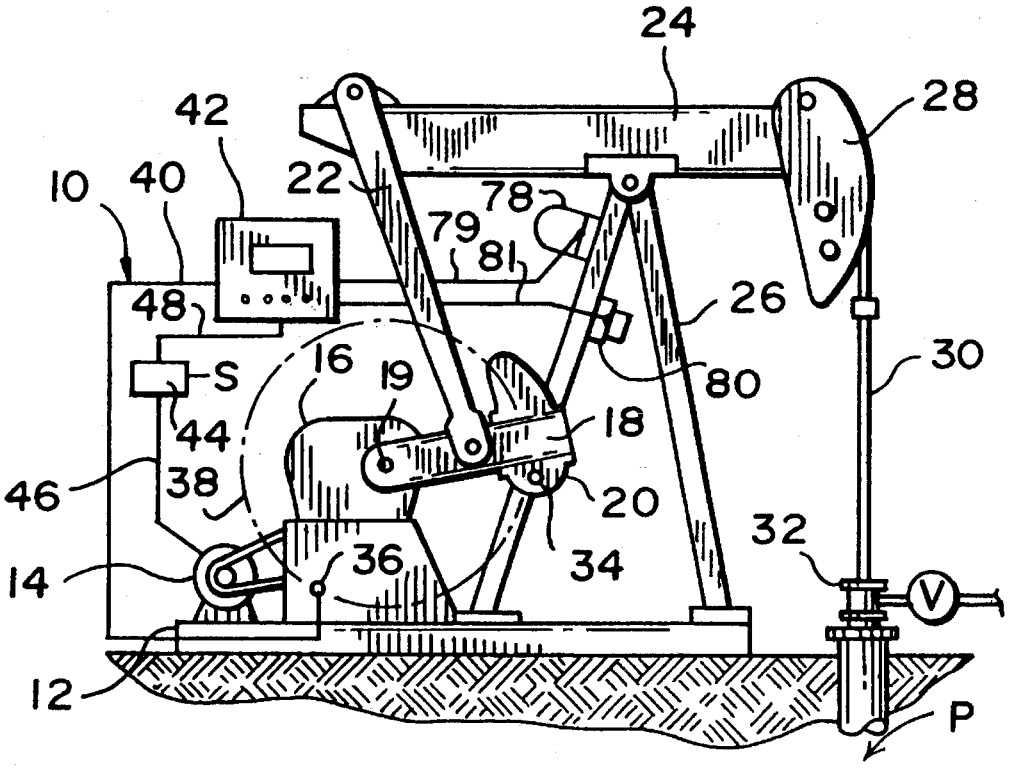
FIG. 1 is part diagram, part schematic, part cross-section, side elevation view of a pumpjack unit having a pump-off control associated therewith made in accordance with the present invention.

In FIG. 1, there is disclosed a prior art pumpjack unit in combination with a pump-off control apparatus 10 made in accordance with U.S. Pat. No. 4,873,635. The pumpjack unit includes the usual base 12, high slip three phase motor 14, and a gear box 16 which rotates crank 18 in the indicated circle 38 about center 19. Counterweight 20 is fastened to the rotating outer end of the crank 18. Pitman 22 connects the crank 18 to a walking beam 24. The walking beam is journaled to the upper end of the Sampson post 26. Horsehead 28 receives the illustrated bridle thereon for reciprocating the usual polish rod 30. Stuffing box 32 sealingly receives the polish rod and forms the upper terminal end of the wellbore, within which a downhole pump "P" is located downhole in the borehole in the usual manner.

The high slip motor 14 drives the reduction gear box 16 which rotates the shaft 19 and thereby oscillates the horsehead 28, which in turn reciprocates the polish rod 30. The polish rod is connected to a rod string (not shown) which reciprocates the plunger of a pump P located downhole in the wellbore. Production occurs through the indicated valve V.

A traveling magnet located at position 34 is attached to the side of the counterweight which is closest adjacent to the gear box. A transducer is mounted in the path of the magnetic flux as shown by the numeral 36, and is responsive to the lines of magnetic flux effected by magnet 34 as the magnet travels to describe circle 38.

Electrical conductor 40 connects the transducer 36 to a pump-off control circuitry 42 made in accordance with my U.S. Pat. No. 4,873,635. A motor controller 44 of prior art design connects a source S of electrical current to the motor 14 by means of the illustrated conductors 46. Conductors 48 connect the pump-off control circuitry 42 to the motor controller 44.

Figure 2:
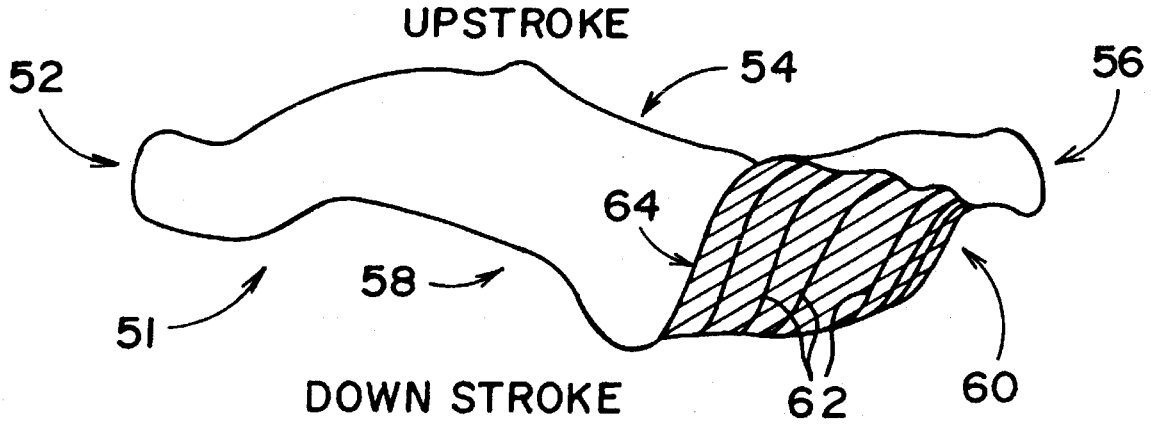
FIG. 2 is a plot showing the operational characteristics of an operating pumpjack unit.

FIG. 2 shows a dynamometer curve. The curve can take on any number of different forms. The dynamometer curve of FIG. 2 is typical of data that can be plotted when the tension in the polish rod 30 is measured and plotted against the position of the reciprocating polish rod, as the rod strokes up and down within the wellbore. Data, such as suggested in FIG. 2, can be mechanically drawn by employing apparatus in accordance with my previous U.S. Pat. Nos. 4,208,665; 4,363,605 and 4,873,635 to which reference is made for further background of this invention.

In FIG. 2, numeral 52 of the plot represents the end of the downstroke of the pumpjack unit of FIG. 1; the upstroke 54 terminates at numeral 56, which also is the start of the downstroke; while part of the downstroke 58 can take on any number of different forms at 60, 62, and 64 depending upon the downhole pumping condition of the wellbore being produced by the pumpjack unit. There are those who have devoted a lifetime of study to the pumpjack and the curve such as seen in FIG. 2.

Figure 3:
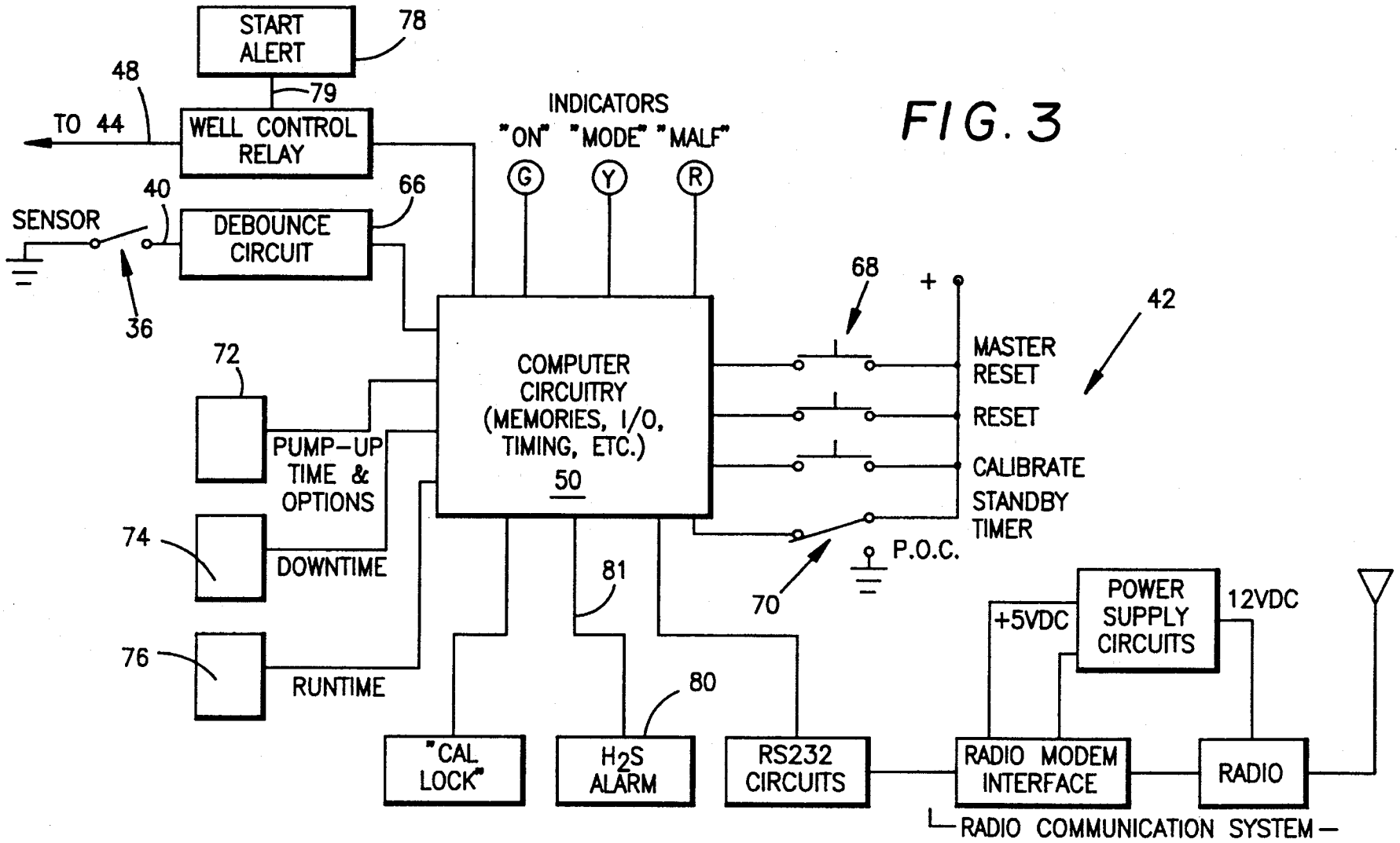
FIG. 3 is a schematic representation of circuitry used in conjunction with the apparatus of FIG. 1.
Figure 5:
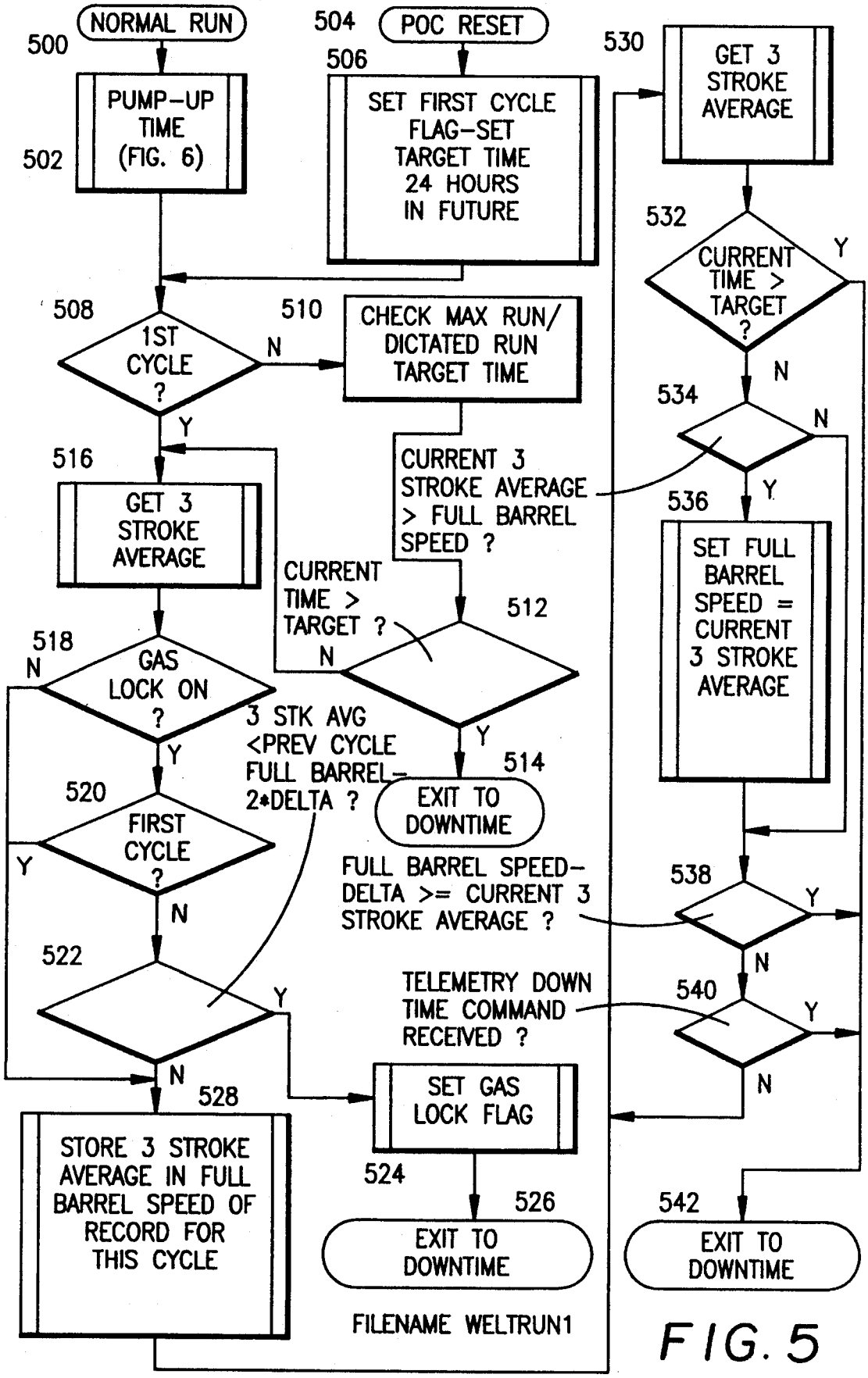
FIG. 5 is a flowchart detailing a normal run of the pumpjack unit.

In FIG. 3, the circuitry 42 includes a computer 50. Transducer 36 is represented in FIG. 5 by the switch illustrated at 36. The switch 36 is connected by conductor 40 to "debounce circuitry" 66, which provides the computer 50 with a clean signal. The debounce circuitry 66 is known to those skilled in the art. Numeral 68 broadly indicates a plurality of switches which include a master reset switch, a reset switch, and a calibrate switch. Numeral 70 indicates a manually operative switch for changing the control circuitry from a pump-off control mode into a standby timer mode.

Numerals 72, 74 and 76, respectively, are "dip switches" for adjusting the pump-up time, down time, and run time, respectively.

FIG. 3 shows the control elements 42 of the pump. Computer 50 is chosen depending on the processing power necessary to run the pump. It could be a standard off the shelf processor such as the Motorola 68030, or the Intel 486. Computer 50 could also be considered to comprise other routine computer apparatus, such as Random Access Memory (RAM), disk, and non-volatile memory input/output I/O technologies. Or the circuit could be a specially designed integrated circuit. Computer 50 includes elements common to the processors listed above, and similar processors.

Computer 50 is connected to several switches 68, including a master reset, reset, calibrate. The standby timer is indicated at 70. A start alert alarm 78 is activated by the well control relay via 79. The start alert 78 is a safety feature for providing a "heads-up" to personnel in the pump area prior to the pump starting up. The well control relay is connected element 44 of FIG. 1 via line 48.

Computer 50 is also connected to one or more sensors via switch 36, line 40, and debounce circuit 66. Switch 36 could either be an activatable switch, which is activated by the sensor to which it is attached. Debounce circuitry is standard circuitry in the art, and is designed to eliminate spurious signals resulting from closure of switch 36.

Elements 72, 74 and 76 are respectively associated with indicators pump-up time & options, downtime, and runtime. Other indicators shown in FIG. 3 include "on," "mode," and "malf" (malfunction), "cal lock," and "$H_2S$ alarm" 80. The latter is connected to computer 50 via line 81.

Computer control system 42 also includes communication circuitry for communicating via radio circuitry which includes RS232 circuitry, power supply, a radio modem interface, and a radio receiver/transmitter. Such circuitry could be advantageously used to communicate operating or historical information from the pump to a remote site. The circuitry could also be used for reprogramming computer 50, or providing new updated operating parameters thereto. Or the circuitry could be used for real-time monitoring and control of the pump and other apparatus at the pump site. Finally, the circuitry could be used to transmit and receive any data routinely used in the operation and maintenance of the pump.

Computer system control 42 may also includes circuitry for implementing an infrared pump-off control system (not shown). This system will be discussed below.

FIG. 4 shows the general flow of control for the dictated run option of the present invention. The flow begins as the computer starts up, and goes through typical power up routines and tests (400). These tests may include, for example, testing memory, sensors, or virtually any of the well apparatus. Flow proceeds to "first down/run cycle" (402) at which time the pump begins operation.

At 404, it is determined whether the dictated run option is on or not. If the dictated run option is not on, steps 406, 408, and 416–422 are bypassed. Flow goes directly to steps 410–414, which include setting enabled gas lock, max run and other options (410), performing a normal run cycle (412), and going through the normal down time (414).

If the dictated run option is on, flow goes to step 406, which determines whether there is a run to pump-off condition. That is, whether there is a zero anticipated cycle count. If there is, the anticipated cycle count is set equal to a customer defined anticipate cycles per pump-off cycle. If not, flow goes to step 416, the last true pump cycle information is consulted to determine the actual run time, and the customer set percentage is also retrieved. At step 418, the anticipated run time or stroke count is calculated. Flow continues to step 420, which sets the maximum run time or maximum stroke count. At step 422, the anticipated cycle count is decremented. Flow then goes to steps 410–414, which have been discussed above.

The flow chart of FIG. 4 is considered to be the general operating cycle of the dictated run cycle, and therefore no exit points are shown. It is understood that the process could be interrupted by any event which is considered to be a routine interruption of a program cycle. For example, the cycle could be interrupted by an operator, field engineer, disaster, or other event.

FIG. 5 shows the details of the "normal run cycle with option tests" step denoted by 412 in FIG. 4. FIG. 5 begins with step 500, which denotes the beginning of a normal run. The procedure begins with pump up time 502, after which it is determined, at step 508, whether the cycle is the first cycle. It should be noted that step 508 can also be reached via the POC reset step 504, which begins by setting the first cycle flag and target time at 506.

If it is determined at step 508 that the first cycle is being performed, flow proceeds to step 516, at which time a three stroke average of the pump is determined. If it is not the first cycle, the max run/dictated target time is checked at step 510. At step 512, if it is determined that current time is greater than the target, the procedure proceeds to step 514, which is an exit to downtime. If the current time in not greater than the target, flow continues to step 516, where the three stroke average is determined, as discussed above.

After the three stroke average is determined at step 516, a determination is made at step 518 as to whether the gas lock is on. If the gas lock is not on, flow proceeds directly to the step of storing the three stroke average at step 528. If the gas lock is on, it is then determined whether this is the first cycle at 520. If it is the first cycle, flow proceeds to the average storing step at 528. If step 520 determines that it is not the first cycle, it is determined at 522 whether the three stroke average is less than the previous cycle full barrel—2 * delta. If the three stroke average is less, flow proceeds to step 524, where the gas lock flag is set, and then flow exits to downtime at 526.

If the three stroke average at 522 is not less than, or if it is determined at step 520 that it is the first cycle, flow continues to 528, which has been discussed above. After the three stroke average is stored, a three stroke average is again determined at 530. At 532, if the current time has exceeded the target, flow immediately progresses to exit to downtime at 542. If the target time has not been exceeded at step 532, it is determined at step 534 whether the current three stroke average is greater than the full barrel speed. If it is greater, the full barrel speed is set equal to the current three stroke average at 536, and flow continues to step 538. If the stroke average comparison step 534 resulted in a negative determination, flow would have continued directly to 538.

At 538, a determination is made as to whether the full barrel speed—delta is greater than or equal to the current three stroke average at 538. If it is greater than or equal to, the procedure exits to downtime at 542. If it is less than, at 538, it is determined at 540 whether a telemetry down time command has been received. If received, the procedure exits to downtime at 542. If not received, the procedure loops back to previously discussed 530.

Figure 6:
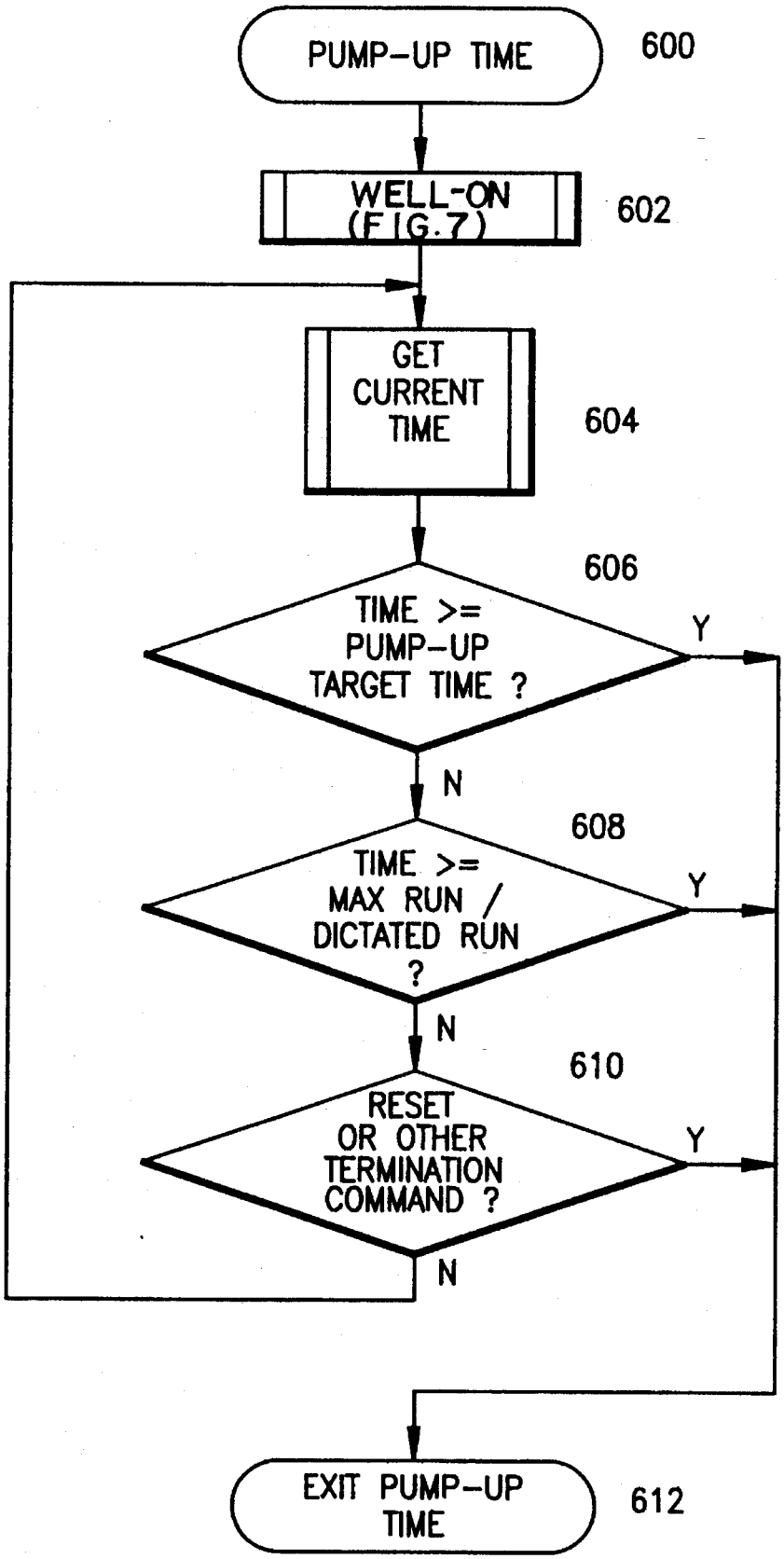
FIG. 6 is a flowchart detailing the procedures regarding pump-up time.

FIG. 6 details the procedure indicated by the pump-up time step 502 of FIG. 5. The pump-up routine of FIG. 6 begins with well on at 602, which will be further elaborated below in the discussion of FIG. 7. Flow continues to step 604, where the current time is determined. If the current time is less than the pump-up target time at 608, it is then determined at 608 whether the time is greater than or equal to the max run/dictated run. If it is less than, it is then determined whether there is a reset or other termination command. If any of the determinations indicated in steps 606, 608 or 610 is positive, the pump-up time procedure is exited at 612. If the command determination at 610 is negative, the procedure loops back to step 604, discussed above.

Figure 7:
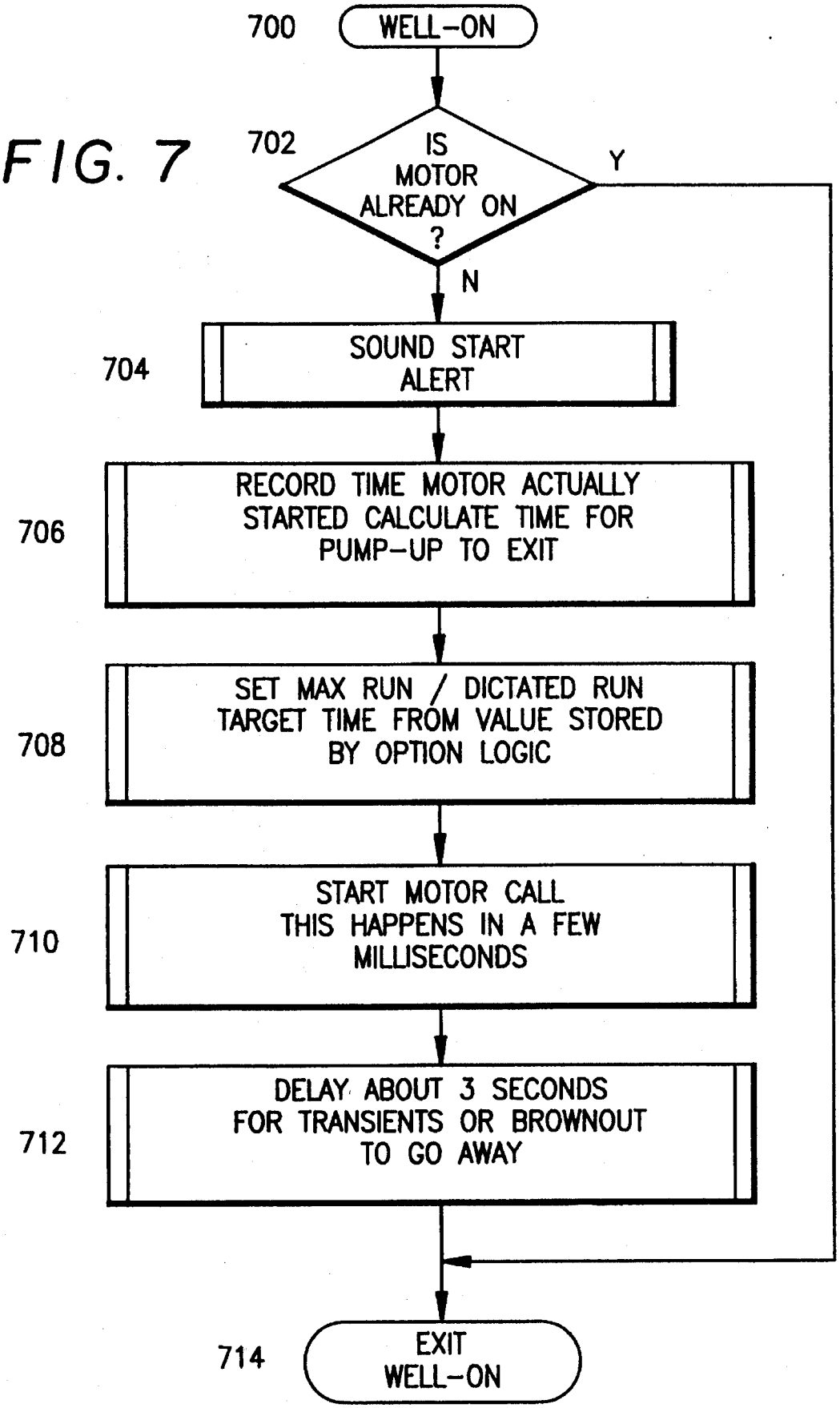
FIG. 7 is a flowchart detailing the steps performed at the time the well equipment is started.

FIG. 7 elaborates the well-on step 602 of FIG. 6. From the start step 700, it is first determined whether the motor is already on at 702. If it is on, the procedure is exited at 714. If the motor is not already on, the start alert is sounded at 704. The time of motor starting is then recorded, and the calculated time for pump-up to exit is determined at 706. The procedure continues to 708, where the procedure sets max run/dictated run target time from value or values stored in memory. At 710 the motor is started, followed by a three second waiting period at 712 to allow transients and brownouts to go away. The procedure then exits at 714.

Figure 8:
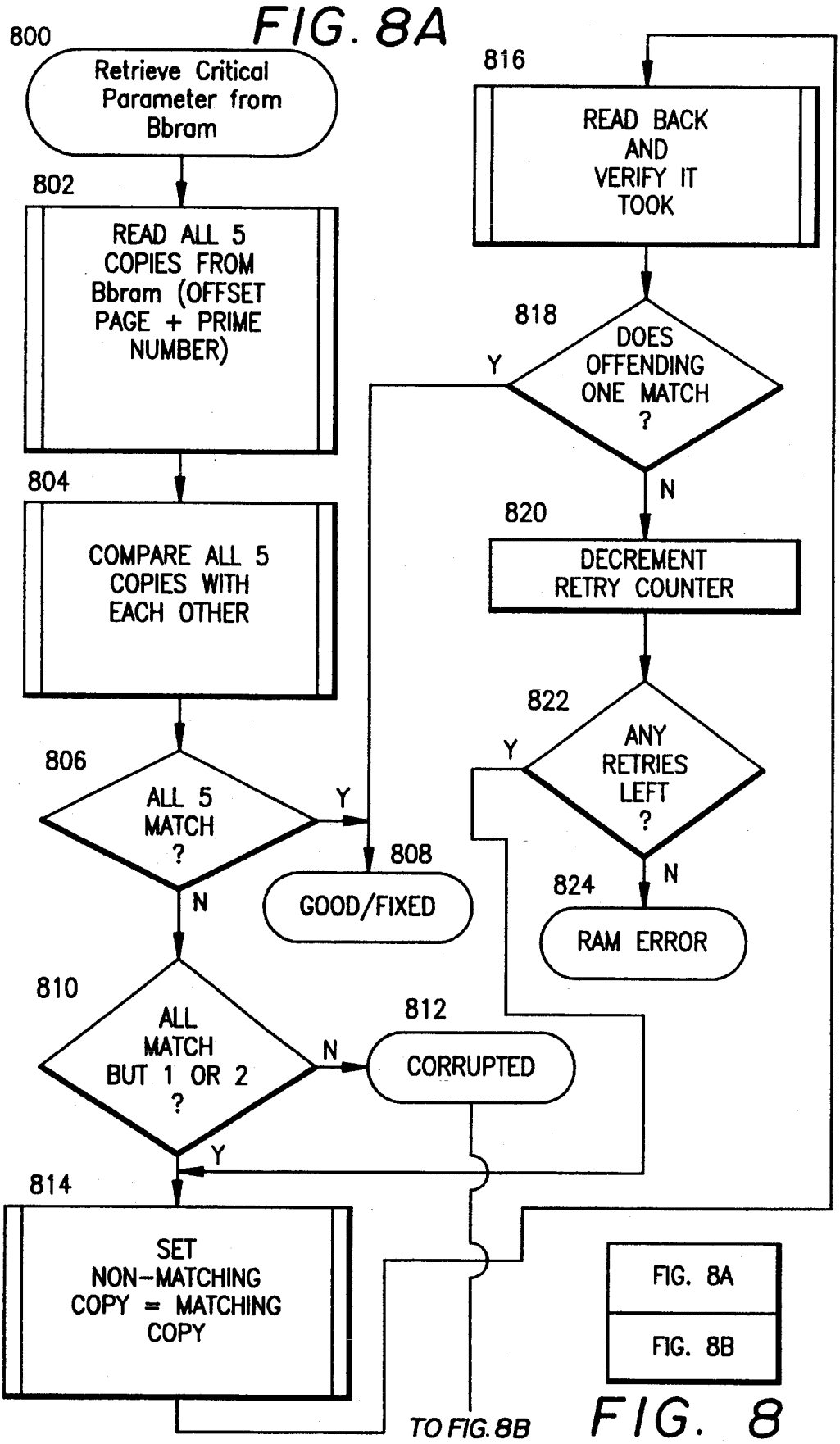
FIG. 8, comprised of FIGS. 8A and 8B, combine to form a flowchart detailing a fault-tolerant approach toward parameter storage.
Figure 8B:
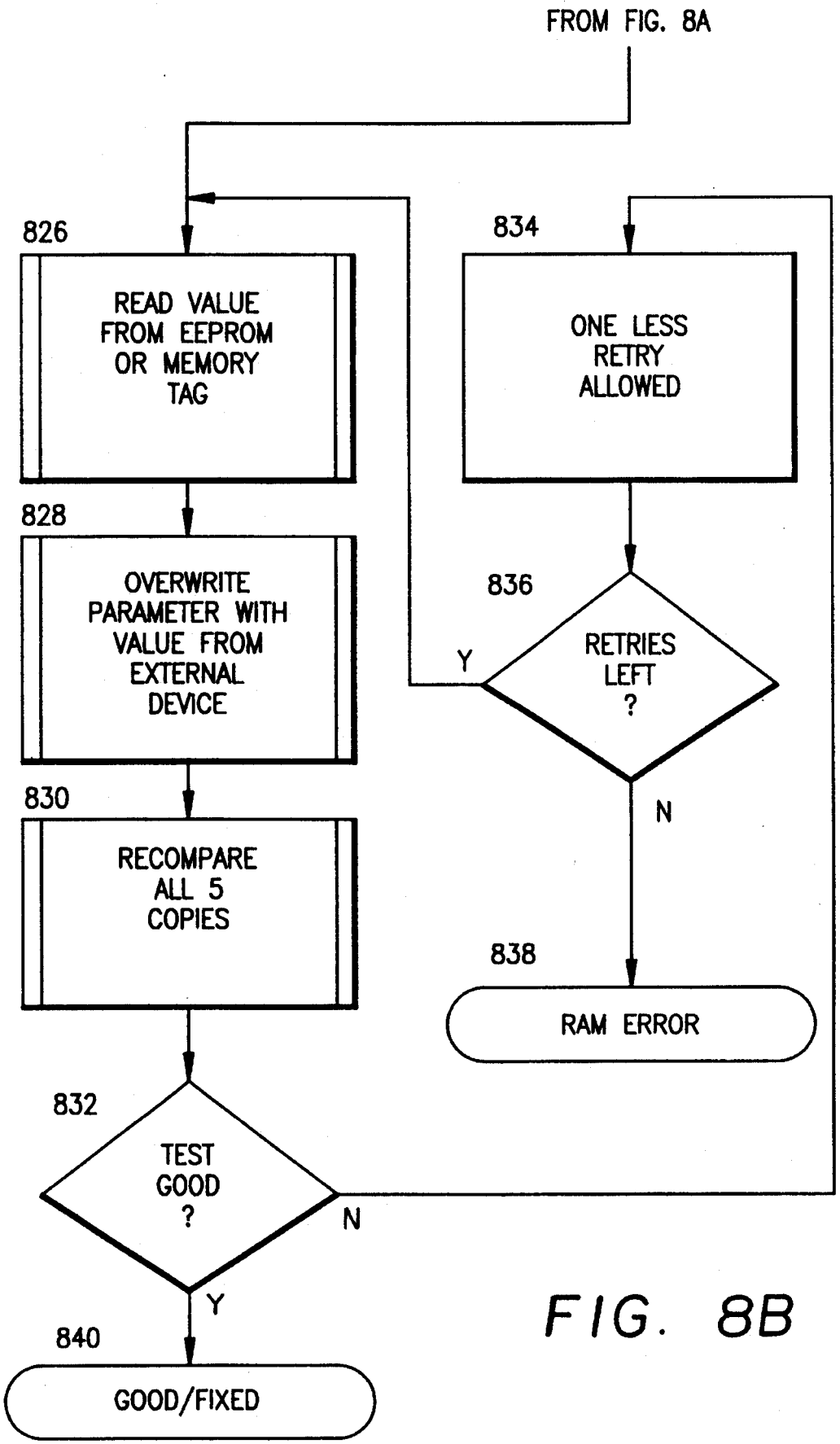

FIG. 8 is a combination of FIGS. 8A and 8B. FIG. 8 is a background process that is essentially always being performed. The procedure begins at step 800, where the critical parameters are retrieved from battery-backed RAM (Bbram). At 802, all five copies from Bbram (offset page+prime number) are read. At 804, all five copies are compared to each other. If they all match (806), the procedure exits because this condition indicates everything is good or fixed (808). Should all five not match, it is determined whether all but one or two match (810). If not even one or two match, this indicates corruption, and the flow goes to FIG. 8B.

If all but one or two do match, on the other hand, the nonmatching copies are set equal to the others (814). This process is then checked by reading the data back to make sure the change took place (816). It is then determined whether the offending copy matches (818). If it does, the procedure exits (808). If it does not match, a retry counter is decremented (820). If all retries have been exhausted (822), the condition is noted as a RAM error (824). If all retries are not exhausted (822), the steps beginning with set nonmatching (814) begins again.

FIG. 8B details the procedural flow which occurs if there is a determination at 812 of Figure A that the data is corrupted. The first step once data is determined to be corrupted is to read data from EEPROM or memory tag (826). The value is then overwritten with a value from an external device (828). All five copies are then recompared (830). If the recomparison is favorable, the procedure ends (840). If the recomparison is not favorable, one less retry is allowed (834). It is then determined if any retries are available to try (836). If so, the steps beginning with 826 are repeated. If there are not any retries available, it is determined that there is a RAM error (838).

OPERATION

The procedure described above provides a method of operation of a pumpjack unit wherein up to 99% of the operation of a pumpjack unit in the fluid pound mode is eliminated by shutting in the well prior to encountering fluid pounding strokes and still maintains a pump-down fluid level at or just above the downhole pump. The software in my U.S. Pat. No. 4,873,635, when used in accordance with the novel method set forth herein, makes this unobvious method of operation possible.

In utilizing this new method, the well is permitted to pump down to the desired fluid pump pound shut-off point, thereby determining the length of a run cycle. At this time, the pump off controller 42 will shut the well off for the programmed downtime. Then 1 to 9 run cycles are programmed to run the well any desired percent of the previous run cycle or pump-down cycle. The selected percent of run time is less than 100% and accordingly the well typically never runs long enough during the 1–9 run cycles to reach a pump-off condition. But if it should, a new run cycle is introduced and the next 1–9 run cycles will be predicated on this new data.

Another variation is to have the 1–9 cycles be finished with the new information regarding time to fluid pounding being used.

EXAMPLE: Assuming that the previous pump-down cycle required a total of ten minutes, the next "indicated" or designated number of run cycles (1–9) would be selected anywhere between 70 and 99% of the ten minute pump-off cycle. The pump-off control would then shut-in the well for each of the dictated number of run cycles at the end of 7 to 9.9 minutes, even though the well would not ordinarily be pounding fluid at shut-in. After the dictated number of run cycles have been reached, the pump-off control causes the well to continue running until the well reaches the fluid pound shut-off point, as seen at 62 in FIG. 2, for example. The new run time for the fluid pound cycle is then automatically set as the dictated run time for the next series of 1–9 run cycles.

Should the fluid pound shut-off occur prior to completion of the 1–9 dictated run time, the pump-off control shuts in the well; and, using the new information regarding time to fluid pounding, shortens the dictated cycle time, and completes the 1–9 cycles. Then everything is repeated all over again.

It is preferred that the pump-off control always updates itself after encountering a fluid pound cycle.

The dictated run cycles can be terminated any time by pressing the "RST" on the keypad. This returns the pump-off control to its "normal" pump-down cycle.

This method of controlling pump-off and fluid pounding in pump-off control technology is unique in the industry, and advantageously adds significantly to the useful life of the sucker rod string and the downhole pump without any loss in production.

Regardless of how pump-down is detected, whether it is a "strain gauge", "load cell", "motor speed", or "polished rod speed", this method of controlling or avoiding "fluid pounding" is applicable and provides unexpected results.

A pump-off condition of operation causes fluid pounding, and results from the pump barrel being only partially filled during the upstroke so that unacceptable jarring of all of the production equipment associated with the production unit results on the downstroke. As seen in FIG. 2, the power expended on the upstroke of a pumpjack is constant while the power expended on the downstroke changes with respect to the amount of fluid contained within the pump barrel. As the well becomes pumped-off, the dynamometer card reflects the pump-off condition as the condition progressively worsens from a full barrel at 60, to progressively less than a full barrel at 62 where the more severe pump-off condition is encountered at 64.

In actual practice, fluid pounding should be totally avoided, and this is achieved by this invention, except for the necessity of occasionally obtaining a the new fluid pound stroke.

Much of the following discussion is to a large degree from my previous patent, and provides information which may be useful in implementing some aspects of my new pump control method outlined above.

The below chart gives data from several wells, and is useful in determining a fluid pounding state, as was discussed in my previous patent.

| 1 SPM | 2 SL | 3 FULL BARREL STROKE TIME | 4 AVERAGE PER MIN | 5 FLUID POUND STROKE TIME SECONDS | 6 AVERAGE PER MIN | 7 DIFFERENCE PER MIN ΔT | 8 PUMP DEPTH |
|---|---|---|---|---|---|---|---|
| 10.5 | 88" | 5.76 | 60.48 | 5.70 | 59.85 | .63 | 5200 |

-continued

| 1 SPM | 2 SL | 3 FULL BARREL STROKE TIME | 4 AVERAGE PER MIN | 5 FLUID POUND STROKE TIME SECONDS | 6 AVERAGE PER MIN | 7 DIFFERENCE PER MIN ΔT | 8 PUMP DEPTH |
|---|---|---|---|---|---|---|---|
| 11.5 | 64" | 5.39 | 61.99 | 5.32 | 61.18 | .81 | 5200 |
| 7.75 | 86" | 7.79 | 60.30 | 7.77 | 60.30 | .04 | 9200 |
| 8.6 | 168" | 7.09 | 60.97 | 7.02 | 60.37 | .60 | 5900 |
| 7.7 | 100" | 7.78 | 59.91 | 7.75 | 59.67 | .24 | 2900 |
| 9.6 | 100" | 6.28 | 60.29 | 6.25 | 60.00 | .29 | 2900 |
| 15.0 | 54" | 3.77 | 56.55 | 3.76 | 56.25 | .30 | 4300 |
| 10.0 | 86" | 6.40 | 64.0 | 6.34 | 63.40 | .60 | 4200 |
| 10.7 | 120" | 5.79 | 61.95 | 5.70 | 60.99 | .96 | 8000 |
| 7.0 | 168" | 9.04 | 63.28 | 9.00 | 63.00 | .28 | 9300 |
| 5.5 | 100" | 10.89 | 59.89 | 10.84 | 59.62 | .27 | 2400 |
| 6.7 | 24" | 8.98 | 60.17 | 8.96 | 60.03 | .14 | 2400 |
| 3.6 | 31" | 16.79 | 60.44 | 16.75 | 60.16 | .28 | 2400 |
| 10.2 | 31" | 5.89 | 60.07 | 5.87 | 59.77 | .30 | 2400 |

As seen in the above chart, the time required for the pump to downstroke with a full barrel is significantly greater than the time required to downstroke the pump with less than a full barrel. Hence, the length of time for one cycle of operation or 360 degrees of rotation of the counterweight 20, progressively decreases as the pump-off condition worsens. A severe pump-off condition compared to a full barrel condition, an amount to ΔT=0.04 to 0.96 minutes as noted in the above chart. Accordingly, the length of time required to downstroke a pump with a full barrel compared to the length of time required to downstroke a pump plunger that has encountered a pump-off condition is considerable.

This time differential is of sufficient magnitude to be utilized to determine that a particular well has encountered a pump-off condition; and, should therefore be shut-in for a length of time required to enable the downhole production zone to recuperate, and before severe fluid pounding is encountered. That is, the well needs to be dormant for a length of time required for the casing annulus to be refilled with formation fluid before restarting the pumpjack unit. This information is available from the production history of any well, and is easily obtained by those skilled in the art.

The downstroke is timed by the provision of a signal which is generated by the cyclic pumping motion of the pumpjack unit. It is preferred to utilize the crank 18 for indexing the position of the downhole pump plunger, and positioning a traveling magnet somewhere on the rotating crank, or on the rotating counterweight associated with the crank, respective to a fixed transducer 36, so that the magnetic flux of magnet 34 passes through the transducer 36 and triggers the transducer at the start 56 of the downstroke 58, as seen in FIG. 2, for example.

The transducer can take on any number of different forms, but preferably is a magnetically actuated switch. Other signal producing apparatus can be utilized as may be deemed desirable.

A well crank arm 18 rotates at about 10 rpm and accordingly, each revolution of the crank requires approximately six seconds. As pointed out above, this measured time will vary several thousandths of a second depending upon rod tension during the downstroke, or the area of the curve of FIG. 2, which varies the load on the high slip motor and causes the high slip motor to significantly change speed as the well progresses from a "full" barrel to a "pump-off" barrel.

The term "pump-off condition" as used herein is intended to comprehend the condition or pumping characteristics of a downhole pump P reciprocated by a sucker rod string, wherein the formation fluid level has been progressively lowered by the pumping action until the pump barrel is only partially full each downstroke of the pump, thereby causing the downhole pump P to progressively proceed towards and eventually encounter a fluid pounding condition. Fluid pounding is a severe pump-off condition which should be avoided because the pounding subjects the downhole pump P, sucker rod string, and the entire pumpjack apparatus to undesirable stress and strain.

Accordingly, as the pump-off condition is approached, it is desirable to shut-in the well for awhile before the pump-off condition becomes pronounced, and then resume production after the fluid in the borehole is replenished in the production zone. This is achieved by measuring the time intervals for the plunger to downstroke with a full barrel, which is less than maximum pump speed, as shown in the above chart. Eventually the pump commences to pump-off, and the time interval for the plunger to downstroke when the pump barrel is less than full decreases until it reaches a value such as indicated in the above chart.

This measurement provides a finite time differential having a predetermined magnitude, and is relied upon by the computer for sending a signal at 48 causing motor controller 44 to de-energize the motor 14 before any fluid pounding is encountered. Next, the computer enters a down-time cycle which can be preset at 74 in FIG. 3. The down-time cycle enables the downhole reservoir to be replenished with formation fluid. Next, the computer energizes the well control relay which first sounds the start alert 78 for ten seconds and then energizes the motor controller at 44.

Switch 70 enables the pump-off control (POC) to be utilized; or, when switch 70 is in the illustrated position of FIG. 3, the sensor 36 is circumvented and the computer starts and stops the well control relay in accordance with the setting of the down-time 74 and run-time 76. Run-time 76 therefore is a timer means included within the computer circuitry that determines the length of time that the motor is energized prior to being de-energized. The run-time and the down-time are both determined by studying the well history or by studying the operation of the well prior to selecting the variables and instructing the computer.

Example I: As the pumpjack reciprocates the polish rod, a signal is generated in transducer 36 by the rotating magnet 34. As seen in the above chart, a pumpjack unit making 8.6 strokes per minute, for example, requires 7.09 seconds for a full barrel stroke; and, only 7.02 seconds for a fluid pound, or less than a full barrel stroke. Accordingly, the length of time for the magnet to complete 360 degrees varies 0.07 seconds when running under full load as compared to the smaller load realized at fluid pounding.

This time differential is used to de-energize the motor 14 and start the down-time. On the other hand, should the traveling magnets speed up to a time of 6.02 seconds, a drastic malfunction must have occurred that is causing the motor 14 to run under a no load condition. Such a change in stroke speed is an indication of rod part somewhere downhole in the borehole. Therefore, the computer 50 is also programmed to shut-in the well whenever the measured stroke time is reduced to a value indicative of no load condition.

Example II. The computer makes a time measurement for every stroke by receiving the signal from the signal generating means or sensor 36.

The computer has been programmed with the procedures discussed above and therefore is imparted with intelligence, and since it monitors all of the different times, it can provide a pump-off control apparatus that shuts-in the well at any predetermined degree or magnitude of fluid pounding, as well as providing sensor failure detection, short run-time malfunction, excessive long-time malfunction, and parted rod malfunction. The apparatus and method of the present invention takes the logical recovery action whenever any of these undesirable conditions are encountered.

The controller knows when it is "fresh from the factory" and automatically goes to the calibration mode. This causes the green L.E.D. light G of FIG. 3 to blink on and off, indicating that the pump-off control (POC) is awaiting a calibration button press. The calibration button should be pressed once, at the desired point of fluid pound. After the calibration button has been pressed, the green L.E.D. will stay on, and the controller will average the last stroke to obtain the fluid pound stroke speed average. The controller will then stop the pump, wait the preset downtime, start the unit, wait the present pump-up time, and then obtain three strokes that represent the full pump stroke speed average.

Using these two numerical values, the controller will calculate the time differential to be used for the pump-off control. This time differential is stored in the battery memory and the working memory for future use. It is important that nothing interrupt the "calibration" cycle. If a bad delta factor is calculated, the controller will not accept the calibrations, it will blink the red L.E.D. R of FIG. 3 for twenty-five seconds, then re-enter the calibration mode. The calibration mode will blink the green L.E.D. when it is ready to accept another calibration button press.

It may be desirable to re-calibrate the pump-off control (POC) after it has been on a well for some time. In this situation, the controller has values stored in the battery memory, and only an update is needed. This is accomplished by pressing the calibrate push button once to enter calibration mode. This will cause the green L.E.D. to blink, and the controller will run the well until the desired magnitude of pump-off is encountered. When this pump-off condition is reached, the calibration push button is pressed again, (a second press). This informs the controller to use the last stroke as the average fluid pound stroke speed. The controller will shut the pump off, wait the preset down-time, start the pump motor, wait the present pump up-time, then obtain the full pump stroke speed average and calculate the appropriate delta factor. Note that this sequence should not be interrupted. This is the normal method of calibrating the pump-off control (POC).

Whenever the power comes on, the well shuts down for the preset time. The controller performs a complete system reset, clears working memory, copies factors stored in battery memory over to working memory, performs other "housekeeping" tasks, and then lights the green L.E.D. to indicate the controller is operational. Note that the green L.E.D. is not a power-on light, but rather it is a "POC OK" light. Failure to light the green L.E.D. indicates some type of hardware problem. If the POC is "fresh from the factory", it will force a calibration. If the POC has been calibrated previously, it will force a down-time, allowing the well to stabilize to a known state, i.e. full pump. This power-up downtime may be interrupted by pressing the reset button, with no ill effects upon POC operation.

The percent timer (standby timer) mode is always indicated by the yellow L.E.D. Y. The controller can enter percent timer operation from three configurations; the first is by setting the "mode" toggle switch to the percent timer position. The second is the result of a sensor failure, which occurs whenever the magnetic switch is open or shorted. Repeated entry into percent timer mode usually indicates an intermittent magnetic switch, or that a conductor wire is shorted together or cut. The third is the "short-run violation". This occurs when the run cycle just completed is less than ½ of the switch setting for the on-time of the percent timer.

Returning to POC mode is the same for all situations including rod part. Press the reset push button once, unless the mode switch is in percent timer position; in this instance, turn the switch back to the POC mode, then press reset button. POC or percent timer can also be reset by momentarily interrupting the AC power supply on the large motor panel; however, this will cause the POC to do a normal down-time if the control is in the POC mode.

The computer program disclosed in FIGS. 4 through 8 are the preferred means by which the present invention can be carried out. However, variations are possible within the scope of the appended claims.

Figure 9:
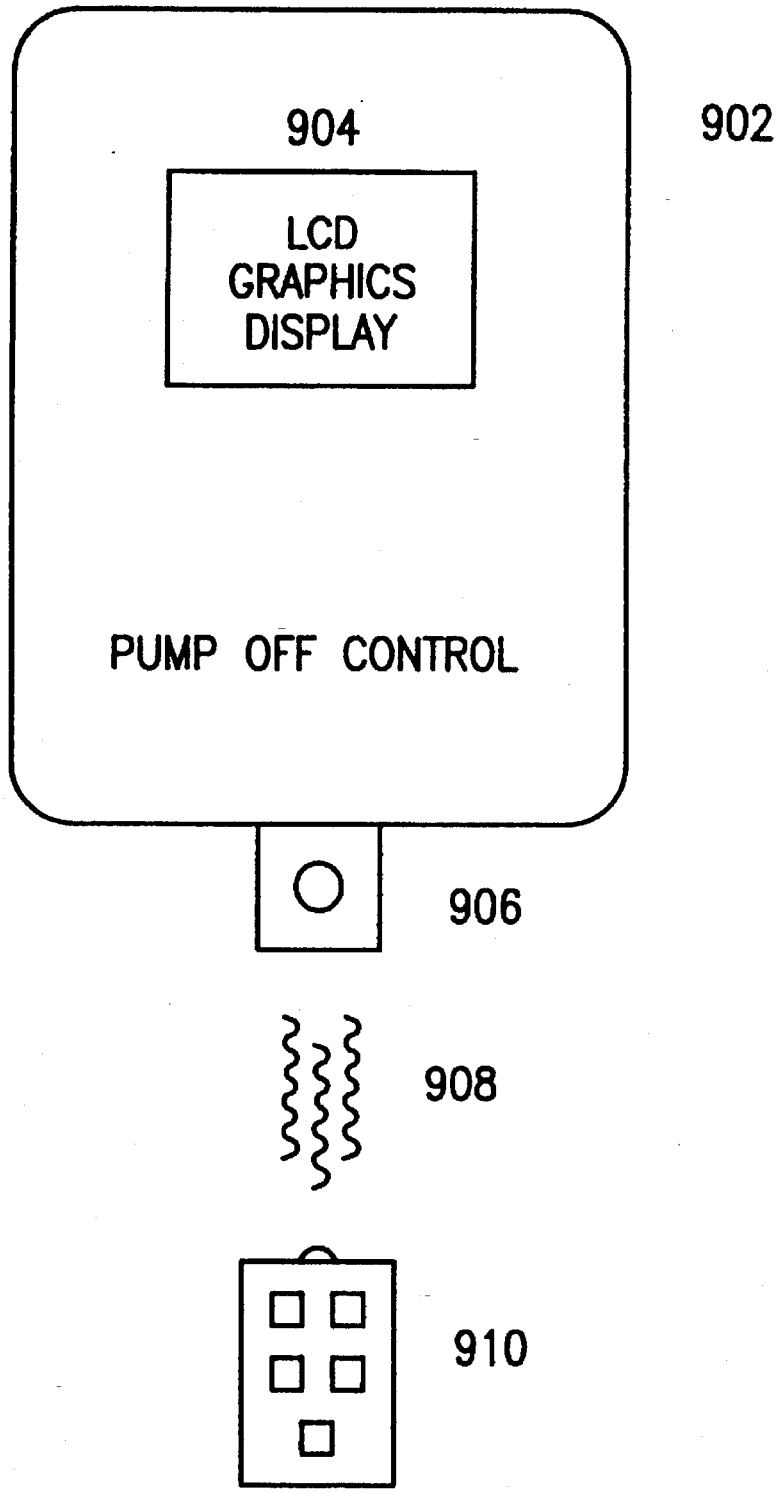
FIG. 9 is a block diagram showing infrared control of pump-off control.

FIG. 9 shows an infrared pump-off control 902. The control includes an display such as an LCD graphics display 904 to provide information to an operator or field engineer regarding the current operating status of the pump. An infrared transceiver such as 906 receives or transmits infrared energy 908 from or to remote control device 910. Advantageously, other forms of remote control could also be used. This feature allows pump-off to be controlled remotely, thus providing greater convenience and safety to a person near the pump.

One skilled in the art, having the present disclosure before him, will be able to program a suitable computer apparatus and achieve all of the above described control expedients. While various preferred embodiments have been shown and described, there is no intent to limit the invention by such disclosure. Rather, the invention is intended to cover all modifications and alternate constructions falling within the spirit and scope of the invention as defined in the appended claims.

I claim:

1. A pump comprising:

means for starting the pump;

means for shutting off the pump when a fluid pounding condition is detected;

means for tracking time representing the time between said starting and said shutting off to determine a tracked time;

means for determining, without requiring the pump to run to a second fluid pounding condition, a first parameter representing a percentage of the tracked time;

means for starting said pump subsequent to said shutting off; and means for shutting off said pump prior to fluid pounding based on said first parameter or upon a fluid pounding condition being met, whichever occurs first.

2. The pump of claim 1, wherein said means for shutting off comprises:

means for activating said means for shutting off up to a predetermined number of times.

3. The pump of claim 2, wherein said means for activating comprises:

means for determining a second parameter from a fluid pounding condition which results in shut-off prior to shutting off said predetermined number of times.

4. The pump of claim 3, wherein said means for determining a second parameter comprises:

means for processing information from said means for determining said second parameter.

5. The pump of claim 4, wherein said means for processing comprises:

means for performing a mathematical function on said second parameter.

6. The pump of claim 3, wherein said means for activating comprises:

means for activating said means for shutting off in accordance with said second parameter.

7. The pump of claim 1, wherein said means for shutting off comprises:

means for activating said means for determining.

8. The pump of claim 1, wherein said means for shutting off comprises:

means for processing information from said means for determining.

9. The pump of claim 8, wherein said means for processing comprises:

means for performing a mathematical function on said first parameter.

10. A method of pumping comprising:

starting the pump;

shutting off the pump when a fluid pounding condition is detected;

tracking time representing the time between said starting and said shutting off to determine a tracked time;

determining, without requiring the pump to run to a second fluid pounding condition, a first parameter representing a percentage of the tracked time;

starting said pump subsequent to said shutting off; and shutting off said pump prior to fluid pounding based on said first parameter or upon a fluid pounding condition being met, whichever occurs first.

11. The method of pumping of claim 10, wherein said shutting off comprises:

activating said shutting off up to a predetermined number of times.

12. The method of pumping of claim 11, wherein said activating comprises:

determining a second parameter from a fluid pounding condition which results in shut-off prior to shutting off said predetermined number of times.

13. The method of pumping of claim 12, wherein said determining a second parameter comprises:

processing information from said determining said second parameter.

14. The method of pumping of claim 13, wherein said processing comprises:

performing a mathematical function on said second parameter.

15. The method of pumping of claim 12, wherein said activating comprises:

activating said means for shutting off in accordance with said second parameter.

16. The method of pumping of claim 10, wherein said shutting off comprises:

activating said means for determining.

17. The method of pumping of claim 10, wherein said shutting off comprises:

processing information from said determining.

18. The method of pumping of claim 16, wherein said processing comprises:

performing a mathematical function on said first parameter.

* * * * *